US006694793B1

(12) United States Patent
Persson

(10) Patent No.: US 6,694,793 B1
(45) Date of Patent: Feb. 24, 2004

(54) PROCESS IN JOINING

(75) Inventor: Jan Persson, Olofström (SE)

(73) Assignee: ABB AB (SE)

( * ) Notice: Subject to any disclaimer, the term of this patent is extended or adjusted under 35 U.S.C. 154(b) by 0 days.

(21) Appl. No.: 09/958,249

(22) PCT Filed: Mar. 20, 2000

(86) PCT No.: PCT/SE00/00549

§ 371 (c)(1),
(2), (4) Date: Jan. 17, 2002

(87) PCT Pub. No.: WO00/62955

PCT Pub. Date: Oct. 26, 2000

(30) Foreign Application Priority Data

Apr. 19, 1999 (SE) ..... 9901397

(51) Int. Cl.[7] ..... B21D 7/22

(52) U.S. Cl. ..... 72/220; 72/10.4; 72/14.4; 72/214; 29/243.58

(58) Field of Search ..... 72/220, 10.6, 13.3, 72/14.5, 14.4, 214, 215, 7.2, 7.3, 8.1, 8.2, 8.4, 9.5, 10.1, 11.1, 15.1, 16.1, 16.4; 29/243.58; 901/29, 45; 413/6

(56) References Cited

U.S. PATENT DOCUMENTS

| | | | | | |
|---|---|---|---|---|---|
| 4,565,081 | A | * | 1/1986 | Massee | 72/20.2 |
| 5,228,190 | A | * | 7/1993 | Sawa | 29/715 |
| 5,477,721 | A | * | 12/1995 | Barnes | 72/203 |

FOREIGN PATENT DOCUMENTS

| | | |
|---|---|---|
| EP | 0 525 759 | 2/1993 |
| EP | 0 577 876 | 1/1994 |
| JP | 2-70325 | 3/1990 |
| JP | 2-197331 | 8/1990 |
| JP | 8-197149 | 8/1996 |
| JP | 61-262432 | 11/1996 |

* cited by examiner

*Primary Examiner*—Allen Ostrager
*Assistant Examiner*—John S Goetz
(74) *Attorney, Agent, or Firm*—Bachman & LaPointe, P.C.

(57) ABSTRACT

In a process in roller folding a folding roller is moved against a workpiece. The urging force of the folding roller against the workpiece is resilient, and the folding roller moves in a path along the workpiece by means of a movement device provided with a control system. The urging force is sensed by a sensor, which is integral in or included in the movement device, and the output signal of the sensor is fed to the control system.

4 Claims, 3 Drawing Sheets

PROCESS IN JOINING

TECHNICAL FIELD

The present invention relates to a process in joining, more precisely a process in roll folding, where a folding roller is moved, with resilient compressive force, against a workpiece in a path along it by means of a movement device provided with a control system.

BACKGROUND ART

In the joining together of two sheet metal parts in such contexts where the demands on surface finish are high, folding or roller folding is often employed as a superior alternative to welding. Roller folding proceeds such that one of the workpieces is given an edge portion projecting out over the other workpiece, the edge portion being folded in over the other workpiece and urged against it so that the edge of the other workpiece will be accommodated between the first workpiece and its folded-over edge portion. During this working cycle, the workpieces rest on and are positionally fixed in relation to a bed which thereby will define the form of the finished fold.

For the above-mentioned folding over of the edge portion of the first workpiece, use is made of a roller which is displaced in the longitudinal direction of the edge portion. Before the folding operation, the first workpiece has its edge portion projecting approximately at right angles or at least transversely directed in relation to the plane of the portion of the workpiece lying inside the edge portion. The roller is then generally moved in three different steps along the edge portion so that this, in a first folding step, is bent at approximately 30° and in a second folding step an additional approximately 30°. The subsequent and last folding step is the crucial step when the surface finish of the workpiece is determined.

The two first folding steps may be carried out without any major requirements on precision in the relative positions between the folding roller and the edge portion of the workpiece. This also applies to the compression force which prevails between the folding roller and the edge portion.

On the other hand, as regards the final step in the folding operation, extremely high demands on the precision of movement are placed, as well as demands on a certain resilience capability in the roller. In addition, the compression force from the roller on the edge portion resting on the bed must often vary along the length of the edge portion so that, for example, in a tightly bent "corner region" of the workpiece, the compression force must be reduced since the edge portion must be considerably narrower in such a curved region.

EP 577 876 shows, with reference to FIGS. 7 and 8; and 9 and 10, respectively, apparatuses for roller folding. Common to both of these embodiments is that an industrial robot carries an end effector or folding head with two main components, where the one main component is connected to the industrial robot while the other main component is movable in relation to the first towards and away from the workpiece, The construction includes a servo apparatus by means of which the mutual position of the two main components can be controlled in order thereby to vary or realise a resilient force in the abutment of the folding roller against the workpiece.

The described embodiments may be feared to suffer from serious drawbacks as regards the precision in the abutment force of the folding roller and its path of movement because of the movable interconnection of the main components in the folding head. Further, the folding head will, naturally, be extremely complicated and expensive.

Further drawbacks in the prior art technology reside in the fact that the apparatus in principle comprises two different movement mechanisms, one for displacing the folding head and one for displacing the folding roller in the folding head. This implies that there are two sources of defective precision both as regards the compression force and accuracy in the path of movement of the roller.

ACCOUNT OF THE INVENTION

The present invention has for its object to formulate the process intimated by way of introduction such that the drawbacks inherent in prior art methods and apparatuses are obviated. In particular, the present invention has for its object to realise a process which may be reduced into practice without the employment of complicated and expensive specialist equipment. Further, the present invention has for its object to realise a process which affords precision advantages compared with prior art technology.

SOLUTION

The object forming the basis of the present invention will be attained if the process intimated by way of introduction is characterised in that the resilience is generated by means of the movement device.

As a result of this feature, advantages will above all be afforded as regards simplicity in the equipment.

BRIEF DESCRIPTION OF THE ACCOMPANYING DRAWINGS

The present invention will now be described in greater detail hereinbelow, with particular reference to the accompanying Drawings. In the accompanying Drawings.

DESCRIPTION OF PREFERRED EMBODIMENT

The present invention will be described hereinbelow by way of example as applied to an industrial robot. Naturally however, it may be applied in any other type of movement device or manipulator which is provided with a control system and which may realise the requisite relative movement pattern between a workpiece and a folding roller. Thus, the term movement device should be given such a broad interpretation as also to include an apparatus which displaces a workpiece in relation to a fixedly disposed folding roller, as well as apparatuses in which both the workpiece and the folding roller move.

Figure 1:
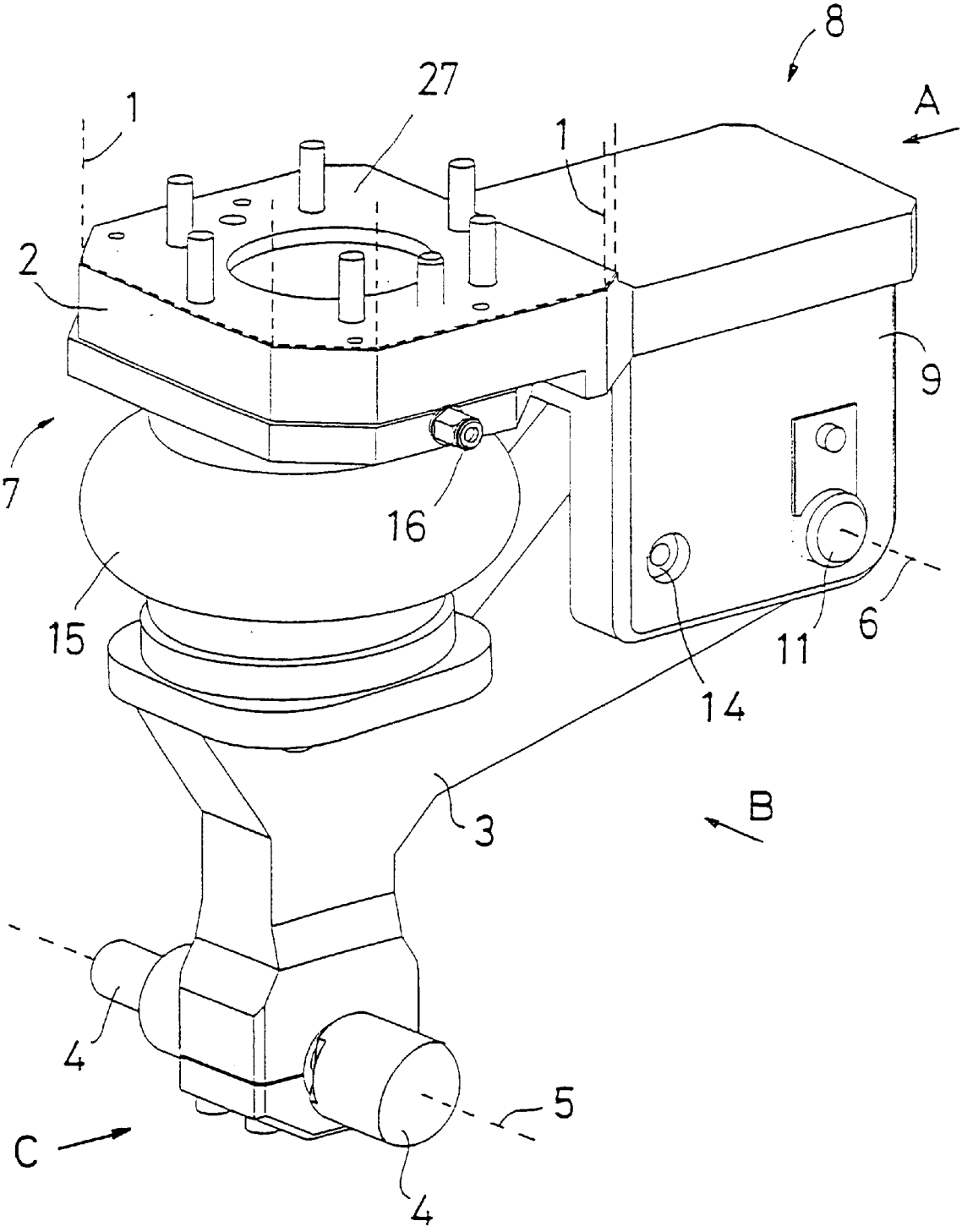
FIG. 1 is a perspective view of a folding head, mounted on an industrial robot, intended to be employed for carrying the process into effect.

In FIG. 1 broken lines intimate a movement device or manipulator 1 included in an industrial robot, the manipulator being that part of the industrial robot which is movable along extremely complicated movement paths and which serves for securing such end effectors or equipment as the robot is to handle. Reference numerals 2 and 3 relate to first and second support members, support members in which the first or upper support member 2 is secured in the manipulator 1 of the robot by means of suitable rapid coupling devices or bolt unions. The second or lower support member 3 supports, on each side, a folding roller 4 which is rotatably journalled in relation to the second support member and which is rotary about a common axis 5. The folding rollers 4 are intended to be in contact with and urge against an edge portion 10 on the workpiece 12 which rests on a bed 13 (FIG. 2) and which is to be folded. Thus, the folding roller is to move along a folding path.

The second support member 3 is movable in relation to the first support member 2 and, in particular, is pivotal in relation thereto about a second axis 6 which is located a distance from the first axis 5 and the anchorage of the first support member 2 in the manipulator 1. This implies that the second support member 3 may execute a pendulum pivotal motion about the second axis 6, whereby the folding roller 4 may be caused to move towards and away from the edge portion 10 of the workpiece.

The pivotal capability of the second support member 3 in relation to the first support member 2 is achieved in that the second support member is accommodated between two lugs, of which only the lug 9 is shown in the Figure. A bearing shaft 11 extends through the two lugs, and defines the second pivot axis 6. The movement region of the second support member 3 is restricted by the presence of a locking pin 14 which extends through both the lugs and through an arcuate curved recess in the second member 3.

Between the two support members, there is disposed a rubber bellows 15 which has an inlet 16 for air.

By the supply of air under pressure to the interior of the bellows, the bellows may be caused to function as a spring whereby the folding roller 4 may be held resiliently urged against the workpiece 12.

However, it is also possible to increase the pressure in the bellows 15 to such a level that the second support member 3 is locked in abutment against the locking pin 14. In this state, the folding roller 4 is rigidly interconnected to the manipulator 1 of the industrial robot and, as a result, slavishly follows its movements.

Figure 2:
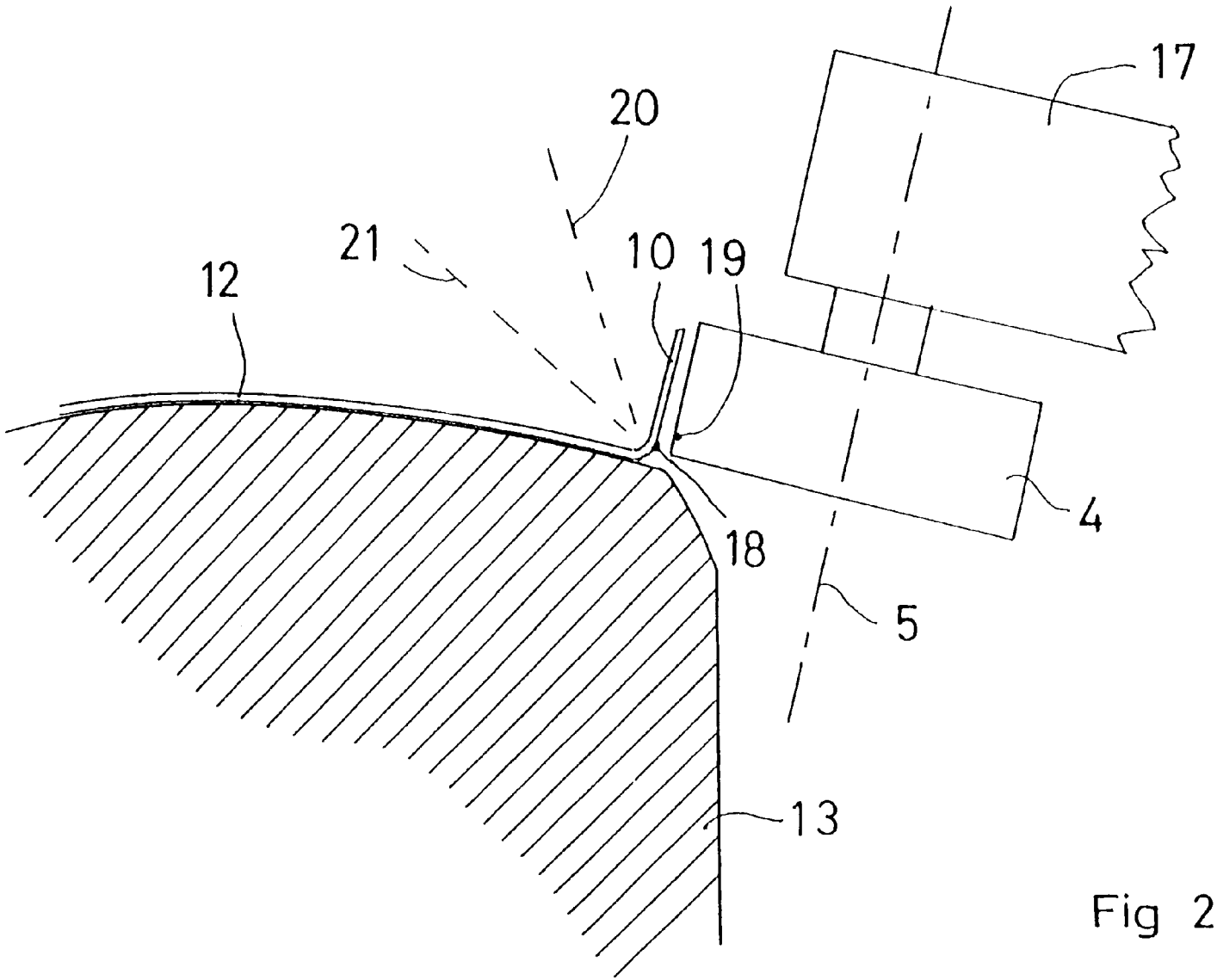
FIG. 2 is a partial section through a workpiece, the bed on which the workpiece rests and a folding roller.

It will be apparent from the foregoing that in those operational states where the bellows has such high pressure that no movement between the folding roller and the manipulator can occur, the folding roller could just as well be directly connected to the manipulator by the intermediary of a totally rigid connecting portion 17 (FIG. 2).

In the production of the workpiece 2, there is documented a line along the edge portion 10, the line being represented by the point 18 in FIG. 2. This line along the periphery of the workpiece 12 is described in computer files which are transferred to the control system in the industrial robot. As a result, the robot becomes aware of the path which is to be followed by the folding roller 4 on execution of a folding cycle.

In order to localise the folding roller 4 in a particular manner in relation to the line 18, a circumference line 19 is defined on the folding roller and this circumference line is intimated in FIG. 2 by the point 19. By displacement of the circumference line 19 in relation to the line 18 in response to material dimensions, folding width etc., which is carried out by the employment of the control system of the robot, the desired mutual position may be achieved between the folding roller and the edge portion 10 along the entire circumference of the workpiece. The folding roller 4 can therefore be caused to follow the desired folding path along the edge portion 10.

Another method of informing the control system of the industrial robot as to the desired folding path could be to allow a specific, narrow-edged sensor roller to follow and scan either the edge portion 10 or a portion of the bed 13 located proximal the edge portion. By such scanning, information may be transferred to the control system of the industrial robot as to the path which the folding roller 4 is subsequently to follow in operation.

When a folding operation, and in particular its final phase, is subsequently to be carried out, correction must take place of the path of the folding roller 4 in relation to the desired path programmed into the robot, if the final result is to be that desired. These corrections include variations of the abutment force of the folding roller against the workpiece 12 along the folding path, resilient spring movements in the folding roller, etc.

The resilience which the robot according to the present invention realises may be passive or active.

The passive resilience is achieved by means of a spring element such as a helical spring, a torsion spring, a resilient rubber element, a gas spring etc., and requires no sensing of the abutment of the roller 4 against the workpiece.

The active resilience is based on the concept that the abutment force of the roller 4 against the workpiece can be sensed by means of a sensor. A force generating device then urges the roller 4 more or less forcibly against the workpiece 12 in response to the output signal from the sensor so that the abutment force of the roller is kept at the desired level.

In FIG. 2, the edge portion 10 is approximately projecting at a right angle from the workpiece 12, and it should be observed that a second workpiece which is to be folded together with the workpiece 12 has been omitted from the Figure.

In a first step in a folding cycle, the edge portion 10 is folded from the position illustrated by solid lines in FIG. 2 and is, in this instance, bent of the order of 30° inwards over the major part of the workpiece 12 to a position which is illustrated by the broken line 20. The precision requirements during this first step in the folding cycle are low, for which reason the folding roller 4 may be kept rigid and immobile in relation to the manipulator 1.

A second phase in the folding cycle is carried out when the edge portion is folded from the position illustrated by the broken line 20 to a new position which is approximately illustrated by the broken line 21. Also during this second step in the folding cycle, the requirements on precision are low, both as regards the relative positioning between the folding roller and the edge portion 10, as well as the abutment pressure from the folding roller against the edge portion. Consequently, also during this second step, the folding roller 4 may be rigid and immobile in relation to the manipulator 1.

With a folding head according to FIG. 1, this implies that the two above-described steps in the folding process are carried out with such high pressure in the bellows 15 that the lower support member 3 is positionally fixed as a result of its urging against the locking pin 14 realised by the bellows 15.

In the completion of the final step in a folding cycle, i.e. folding over of the edge portion 10 from the position illustrated by means of the broken line 21 to a position approximately parallel with the main part of the workpiece 12 and in abutment against the second workpiece (not shown in FIG. 2), the requirements on precision, resilience and power control are considerable.

In the final step in the folding cycle, i.e. the final folding, the folding roller 4 is moved with a resilient urging force against the workpiece 12 in a path along it. In order to compensate for such inaccuracies in the path of movement which may possibly occur, it is essential that the folding roller 4 be permitted to spring in a direction towards and away from the edge portion 10. According to the present invention, this resilient function is realised in the industrial robot. In such instance, the urging force of the folding roller 4 against the edge portion 10 is sensed by means of a sensor which is integrated in or included in the industrial robot. The output signal from this sensor is fed to the control system of the industrial robot so that the industrial robot in itself, with its own movement devices, may realise the necessary resilience capability.

In one embodiment of the invention, that sensor which is employed for measuring the abutment force of the folding roller against the workpiece 12 is one or more of the drive motors included in the robot. This is possible by sensing of the current which, at constant voltage, is fed to the drive motors.

In another embodiment of the present invention, use is made of a specific sensor which is positively placed between the folding roller 4 and the power generating devices of the robot, i.e. its drive motors. In one embodiment, this sensor is placed at the interface between the folding head and the manipulator 1.

However, in one embodiment according to FIG. 1, the bellows 15 may also be employed as a sensor for emitting a signal to the control system of the robot, which thereby controls the drive motors of the robot in such a manner that the requisite resilience is achieved. If the bellows is given so high an inner pressure that, in principle, it no longer functions as a spring but has not yet urged the second support member 3 to the stop position against the locking pin 14, and if its inlet 16 is shut off, the inner pressure in the bellows 15 can be sensed and employed as an input signal to the control system of the robot.

Figure 3:
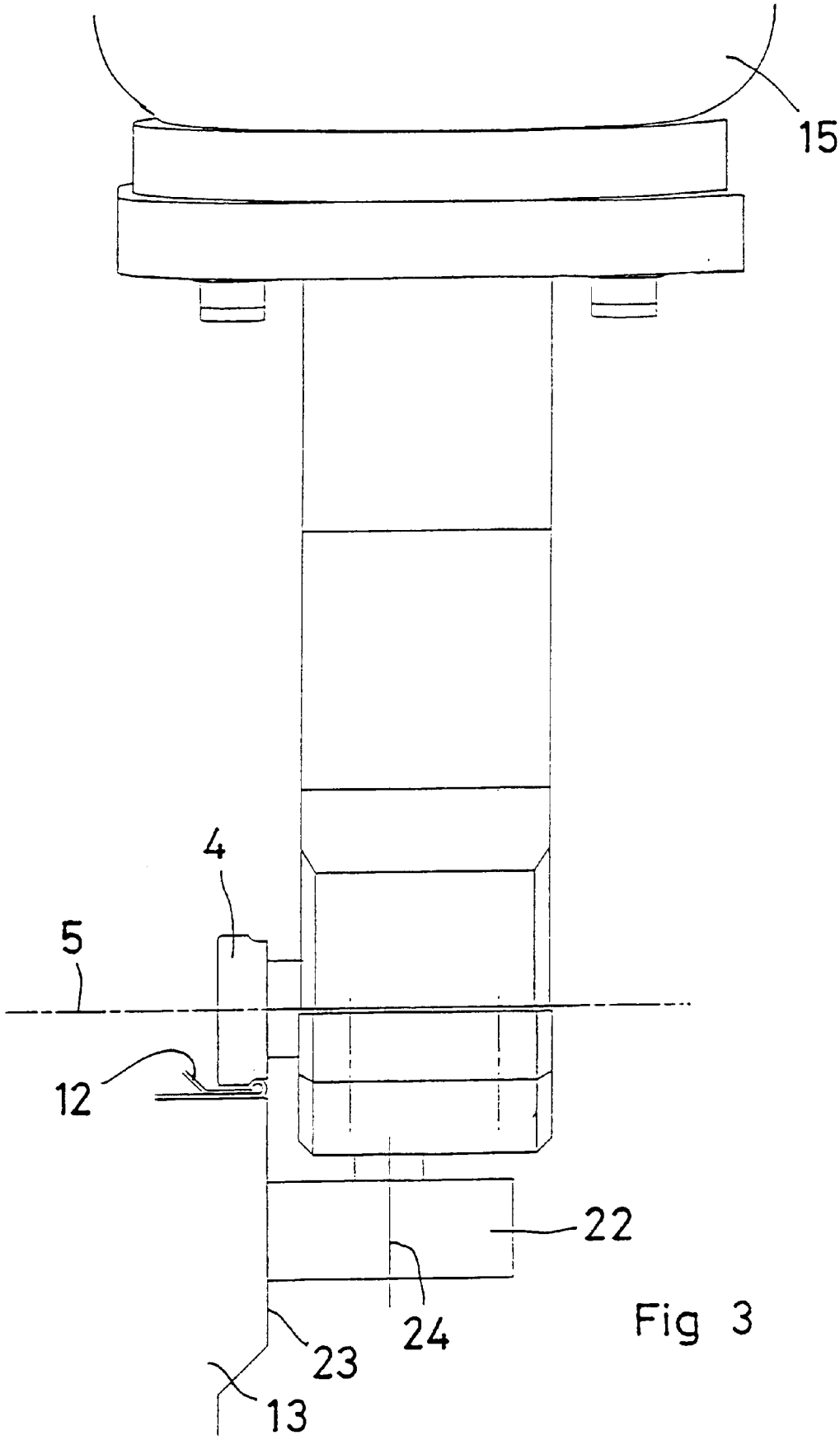
FIG. 3 shows a lower portion of a modified folding head seen in the direction according to the arrow C in FIG. 1.

FIG. 3 shows a modified folding head which is designed, at least during the final folding, to offer even better precision. The folding head has, in addition to the folding roller 4, a guide roller 22 which is designed to follow a guide path 23 on the bed 13. In the illustrated embodiment, the guide roller 22 has an axis of rotation 24 running in the vertical direction of the folding head and approximately parallel to the direction in which the folding roller 4 moves in its resilient movement towards and away from the workpiece during the final folding. The illustrated orientation of the guide path 23 and the guide roller 22 entail that the folding roller 4 will be guided extremely accurately in the lateral direction of the fold which is in the process of being produced.

In the embodiment according to FIG. 3 the guide roller 22 may have a running path with a coating of a resiliently yieldable or elastic material such as a plastic or rubber material. Alternatively, such material may be disposed on the guide path 23.

What is claimed is:

1. A process for folding a workpiece comprising the steps of providing a folding roller:

defining a first path along an edge portion of the workpiece and recording this path in computer means of movement device means;

applying a resilient urging force to the folding roller by movement device means for moving the folding roller against the workpiece along the edge portion of the workpiece;

defining a second path along a circumference line on the folding roller;

sensing the resilient urging force by a sensor means; generating an output signal from the sensor means in response to the sensed resilient urging force; and feeding the output signal to the movement device means to keep the first and the second paths in a redetermined relationship to one another.

2. The process as claimed in claim 1, wherein the sensor means comprises drive means included in the movement device means.

3. The process as claimed in claim 1, wherein the sensor means positively disposed between the folding roller and the movement device means.

4. The process as claimed in claim 1, wherein the folding roller, at least during a final step of a folding cycle, is guided in a lateral direction with respect to the fold, wherein a guide roller follows the path on a bed on which the workpiece rests.

* * * * *

UNITED STATES PATENT AND TRADEMARK OFFICE

CERTIFICATE OF CORRECTION

PATENT NO. : 6,694,793 B1
DATED : February 24, 2004
INVENTOR(S) : Jan Persson

It is certified that error appears in the above-identified patent and that said Letters Patent is hereby corrected as shown below:

Column 1,
Line 61, the "," after the word "workpiece" should be corrected to -- . --.

Column 6,
Line 30, the word "redetermined" should be corrected to read as -- predetermined --.

Signed and Sealed this

Sixth Day of July, 2004

JON W. DUDAS
*Acting Director of the United States Patent and Trademark Office*